US007259721B2

(12) United States Patent
Chang et al.

(10) Patent No.: US 7,259,721 B2
(45) Date of Patent: Aug. 21, 2007

(54) REFLECTING BOARD WITH VARIABLE SLOT SIZE FOR A MICROSTRIP REFLECTARRAY ANTENNA

(75) Inventors: The-Nan Chang, Taipei (TW); Bor-Tsong Chen, Taipei (TW)

(73) Assignee: Tatung Company, Taipei (TW)

( * ) Notice: Subject to any disclaimer, the term of this patent is extended or adjusted under 35 U.S.C. 154(b) by 38 days.

(21) Appl. No.: 11/362,779

(22) Filed: Feb. 28, 2006

(65) Prior Publication Data

US 2007/0103368 A1 May 10, 2007

(30) Foreign Application Priority Data

Nov. 9, 2005 (TW) ..... 94139304 A

(51) Int. Cl.
*H01Q 1/38* (2006.01)

(52) U.S. Cl. ..... 343/700 MS; 343/846

(58) Field of Classification Search ..... 343/700 MS, 343/829, 846, 853
See application file for complete search history.

(56) References Cited

U.S. PATENT DOCUMENTS 4,977,406 A * 12/1990 Tsukamoto et al. .. 343/700 MS
5,001,492 A * 3/1991 Shapiro et al. ..... 343/700 MS
6,366,244 B1 * 4/2002 Fernandes ..... 343/700 MS
6,424,299 B1 * 7/2002 Cha et al. ..... 343/700 MS
7,098,854 B2 * 8/2006 Herrick ..... 343/700 MS

* cited by examiner

*Primary Examiner*—Tho Phan
(74) *Attorney, Agent, or Firm*—Bacon & Thomas, PLLC

(57) ABSTRACT

The present invention relates to a reflecting board for a microstrip reflectarray antenna and, more particularly, to a reflecting board with variable slot size that can improve the design flexibilities of the reflecting board and reduce the sensitivity to the manufacturing tolerances of the microstrip reflectarray antenna. The reflecting board comprises a bottom substrate having a first lower surface, and a top substrate. Plural first microstrip antenna patches, and plural second microstrip antenna patches with rectangular slots are disposed on the upper surface and the second lower surface of the top substrate, respectively. The area of the second microstrip antenna patches is larger than that of the first microstrip antenna patches. Besides, the ratio of the maximum border-length of the rectangular slot to the maximum border-length of the corresponding second microstrip antenna patch is identical for each second microstrip antenna on the second lower surface of the top substrate.

18 Claims, 7 Drawing Sheets

REFLECTING BOARD WITH VARIABLE SLOT SIZE FOR A MICROSTRIP REFLECTARRAY ANTENNA

BACKGROUND OF THE INVENTION

1. Field of the Invention

The present invention relates to a reflecting board for a microstrip reflectarray antenna and, more particularly, to a reflecting board with variable slot size that can improve the design flexibilities of the reflecting board and reduce the sensitivity to the manufacturing tolerances of the microstrip reflectarray antenna.

2. Description of Related Art

To provide broad bandwidth for high frequency communication, a microstrip reflectarray antenna is often used to transmit and receive a high frequency signal. As shown in FIG. 1A, the microstrip reflectarray antenna comprises a disc 11 and a horn 12. In addition, plurality of antenna patches 14 are disposed on the upper surface 13 of the disc 11, and a metal grounding-layer (not shown) is disposed on the lower surface of the disc 11. The horn 12 is coupled to the disc 11 through a support 15 at a predetermined distance above the disc 11. Therefore, as the reflect-array antenna 1 receives a high-frequency signal coming from a distant terminal, the high-frequency signal is concentrated and reflected to the horn 12 by the antenna patches 14 on the disc 11, and this signal is then received by the horn 12. On the contrary, as the reflect-array antenna 1 transmits a high-frequency signal, the signal transmitted from the horn 12 is reflected by the antenna patch 14 on the disc 11, and send to a distant-terminal receiving device.

To improve the gain and the bandwidth of the reflect-array antenna 1, the patterns of the antenna patches 14 are usually different from each other. Besides, the patterns of the antenna patches 14 variably depend on their location on the disc 11. Generally speaking, the patterns of the antenna patches 14 are divided into three types.

1. As shown in FIG. 1B, plural antenna patches 141, 142, 143, 144 disposed on the upper surface 13 of the disc 11 have delay lines 145, 146, 147, 148 with different lengths, separately. The function of these delay lines is to adjust the phase difference of the high-frequency signal reflected by the disc 11. This signal also controls the main beam direction after reflection. Hence, the high-frequency signal reflected by the disc 11 can be gathered effectively in the horns, and therefore, the reflectarray antenna 1 can transmit and receive the high-frequency signal.

2. As shown in FIG. 1C, plural antenna patches 14 disposed on the upper surface 13 of disc 11 could have different rotation angles or different types of delay lines (i.e. straight delay line 161 and bent delay line 162). It is known that the gain and the bandwidth of the reflectarray antenna 1 having this kind of antenna patch 14 are improved. Besides, the reflected high-frequency signal can be gathered in the horn 12 effectively, and therefore, the reflectarray antenna 1 can transmit and receive the high-frequency signal.

3. As shown in FIG. 1D, the disc 11 may have two-layer structured antenna patches thereon (i.e. the first antenna patches and the second antenna patches). Besides, these two-layer structured antenna patches could have different sizes according to their positions on the surface 13 of the disc 11. It can be seen that the first antenna patches 171, 172, 173, 174 are disposed on the upper surface 13 of the disc 11 and the second antenna patches 175, 176, 177, 178 are disposed on the lower surface (not shown) of the disc 11.

Moreover, the ratio of the size of the first antenna patch to the size of the corresponding second antenna patch is identical for each first antenna patch on the upper surface 13 of the disc 11. For example, the border-length of the first antenna patch could be 0.6 times of the border-length of the corresponding second antenna patch.

However, the entire performance of reflecting array antenna is easily affected by the size and arrangement of the patterns of the antenna patches due to the material properties of the disc (e.g. the dielectric constant). Hence, producing the design of the disc is very difficult. Besides, the size and the position of every antenna patch needs to be manufactured precisely, otherwise, the high-frequency signal cannot be reflected effectively by the disc, and the performance (e.g. gain, bandwidth, or efficiency) of the disc can not be improved.

Therefore, it is desirable to provide a reflecting board with variable slot size to increase the design flexibility of the reflecting board and reduce the effect of manufacturing error on the performance of the microstrip reflectarray antenna. In this way, the manufacture cost of the microstrip reflectarray antenna can be lessened and the manufacture yield of the reflecting board can be raised.

SUMMARY OF THE INVENTION

A reflecting board for a microstrip reflectarray antenna, comprising: a bottom substrate having a first lower surface, wherein a grounding plate is disposed on the first lower surface to ground the bottom substrate; and a top substrate having an upper surface, a second lower surface, plural first microstrip antenna patches, and plural second microstrip antenna patches, wherein the first microstrip antenna patches are disposed on the upper surface and the second microstrip antenna patches with rectangular slots are disposed on the second lower surface; wherein each second microstrip antenna patch on the second lower surface is located opposite to the corresponding first microstrip antenna patch on the upper surface of the top substrate, the ratio of the area of the first microstrip antenna patch to the area of the corresponding second microstrip antenna patch is identical for each first microstrip antenna patch on the upper surface of the top substrate, and the ratio of the maximum border-length of the rectangular slot to the maximum border-length of the corresponding second microstrip antenna patch is identical for each second microstrip antenna on the second lower surface of the top substrate.

Therefore, through forming a slot in the second microstrip antenna patch, the design flexibility of the reflecting board is improved, and the sensitivity of the performance of the microstrip reflectarray antenna to the manufacturing precision of the reflecting board is reduced. Moreover, the same performance of the reflecting board can be obtained by using a microwave substrate with high dielectric constant. Comparing with the conventional microstrip reflectarray antenna, the cost of the reflecting board of the present invention is lessened, the area of the reflecting board of the present invention is reduced, and the yield of the reflecting board of the present invention is enhanced.

In addition, the reflecting board of the present invention can be co-operated with any kind of transceiving element, which is used to receive and transmit a high-frequency signal, to form a microwave reflectarray antenna. Preferably, the transceiving element is a horn. The frequency of the high-frequency signal is not limited. Preferably, the frequency of the high-frequency signal ranges from 10.4 to 12.4 GHz.

The material of the bottom substrate of the present invention is not limited. Preferably, the bottom substrate is an FR-4 microwave substrate, a Duroid™ microwave substrate, a Teflon™ microwave substrate, a Rohacell™ microwave substrate, a GaAs microwave substrate, or a ceramics microwave substrate. The material of the top substrate of the present invention is not limited. Preferably, the top substrate is an FR-4 microwave substrate, a Duroid™ microwave substrate, a Teflon™ microwave substrate, a Rohacell™ microwave substrate, a GaAs microwave substrate, or a ceramics microwave substrate. The dielectric constant of the bottom substrate is not limited. Preferably, the dielectric constant of the bottom substrate ranges from 2 to 12. The dielectric constant of the top substrate is not limited. Preferably, the dielectric constant of the top substrate ranges from 2 to 12.

Besides, the shape of the reflecting board of the present invention is not limited. Preferably, the shape of the reflecting board is a square, a rectangle, or a circle. The material of the grounding plate is not limited. Preferably, the grounding plate is made of copper, aluminum, or gold. The material of the first microstrip antenna patches is not limited. Preferably, the first microstrip antenna patch is made of copper, aluminum, or gold. The material of the second microstrip antenna patches is not limited. Preferably, the second microstrip antenna patch is made of copper, aluminum, or gold. The shape of the first microstrip antenna patch is not limited. Preferably, the shape of first microstrip antenna patch is a square, or a rectangle. The shape of the second microstrip antenna patches is not limited. Preferably, the shape of second microstrip antenna patch is a square, or a rectangle.

Furthermore, the border-length of the first microstrip antenna patch is not limited. Preferably, the border-length of the first microstrip antenna patch is 0.5 to 0.8 times of the corresponding border-length of the second microstrip antenna patch. More preferably, the border-length of the first microstrip antenna patch is 0.6 to 0.7 times of the corresponding border-length of the second microstrip antenna patch. The border-length of the rectangular slot is not limited. Preferably, the maximum border-length of the rectangular slot is 0.2 to 0.8 times of the corresponding border-length of the corresponding second microstrip antenna patch. More preferably, the maximum border-length of the rectangular slot is 0.6 to 0.7 times of the corresponding border-length of the corresponding second microstrip antenna patch. The area of the second microstrip antenna can be constant or variable. Preferably, the area of the second microstrip antenna depends on the location of the second microstrip antenna.

Other objects, advantages, and novel features of the invention will become more apparent from the following detailed description when taken in conjunction with the accompanying drawings.

DETAILED DESCRIPTION OF THE PREFERRED EMBODIMENT

Figure 1A:
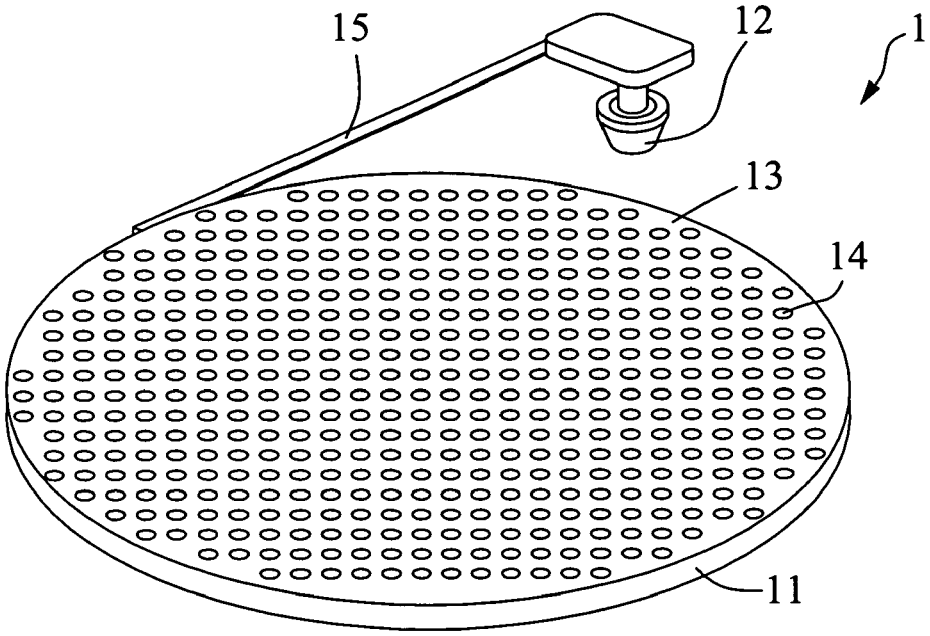
FIG.1A PRIOR ART
FIG. 1A is a schematic drawing of a prior art microstrip reflectarray antenna.
Figure 1B:
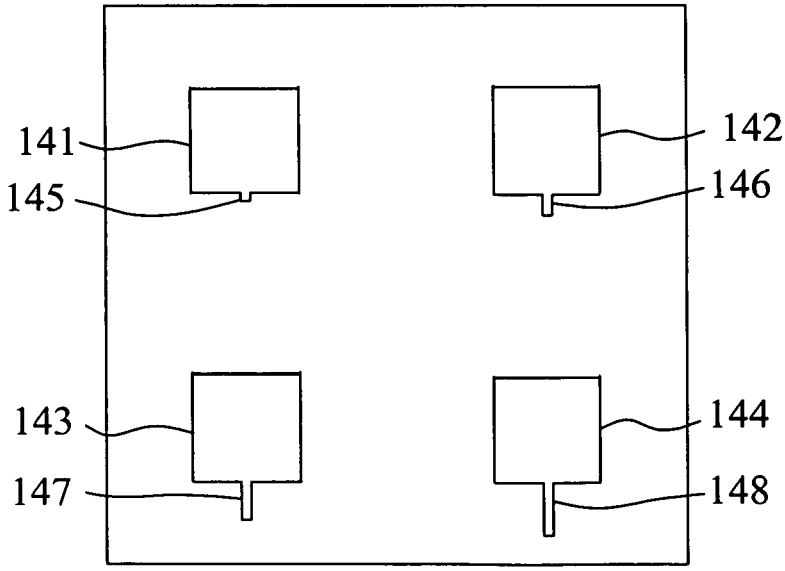
FIG.1B PRIOR ART
FIG. 1B is a schematic drawing of antenna patches according to a prior art microstrip reflectarray antenna.
Figure 1C:
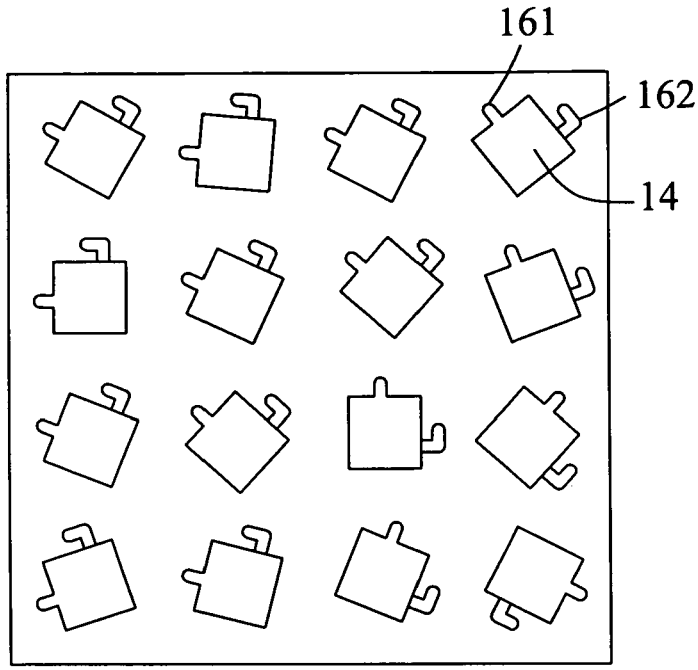
FIG.1C PRIOR ART
FIG. 1C is a schematic drawing of antenna patches according to the other prior art microstrip reflectarray antenna.
Figure 1D:
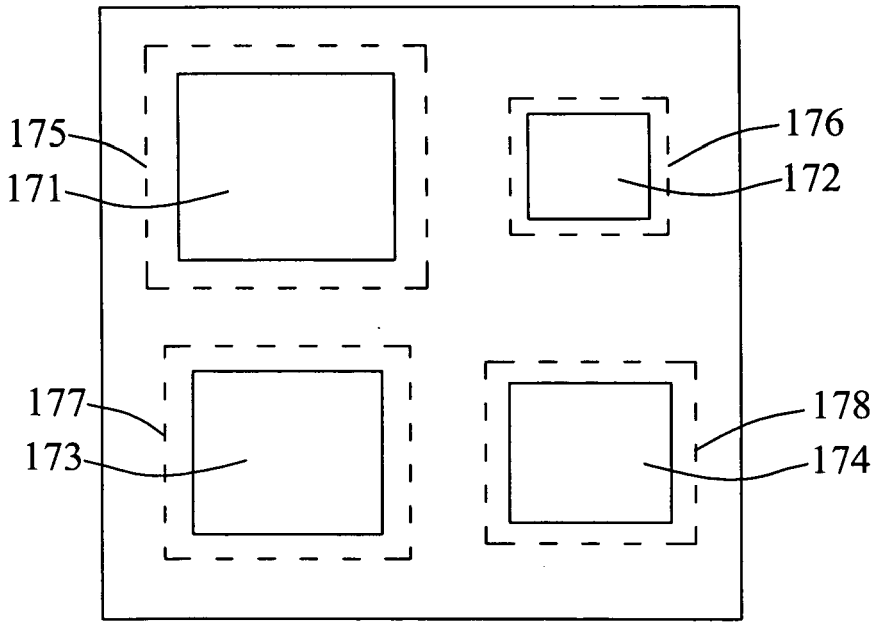
FIG.1D PRIOR ART
FIG. 1D is a schematic drawing of antenna patches according to another prior art microstrip reflectarray antenna.
Figure 2A:
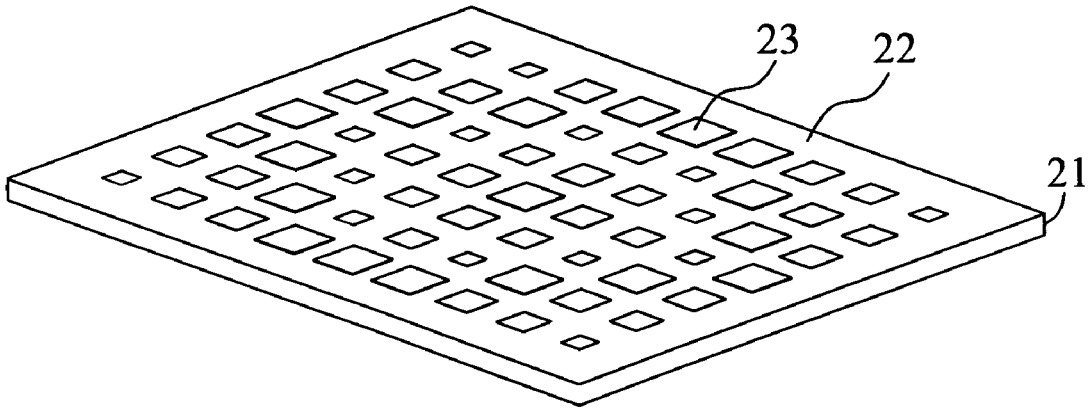
FIG. 2A is a top view of the top substrate according to the first preferred embodiment of the present invention.
Figure 2B:
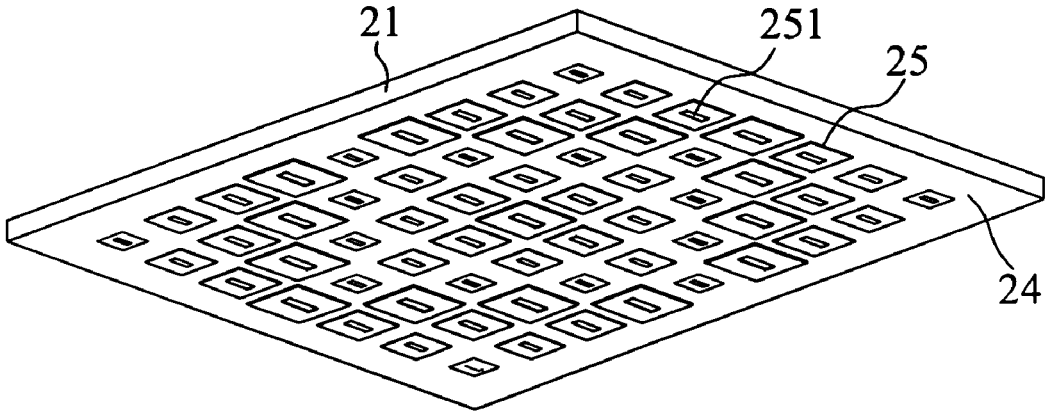
FIG. 2B is a bottom view of the top substrate according to the first preferred embodiment of the present invention.

FIG. 2A and FIG. 2B illustrate the top view and bottom view of the reflecting board of the first preferred embodiment of the present invention, respectively. FIG. 2A shows that plural first microstrip antenna patches 23 are disposed on the upper surface 22 of the top substrate 21. Each first microstrip antenna patch 23 is a square in shape, and its area depends on its location on the upper surface 22 of the top substrate 21. FIG. 2B shows that plural second microstrip antenna patches 25 with rectangular slots 251 are disposed on the lower surface 24 of the top substrate 21. Each second microstrip antenna patch 25 is a square in shape, and its area depends on its location on the top substrate.

Referring to FIGS. 2A and 2B, the second microstrip antenna patch 25, which is opposite to the first microstrip antenna patch 23, corresponds to the first microstrip antenna patch 23 one-to-one. Therefore, each first microstrip antenna patch 23 and its corresponding second microstrip antenna patch 25 can be seen as an antenna unit cell, the dimensions of which are 15 mm×15 mm.

Figure 3A:
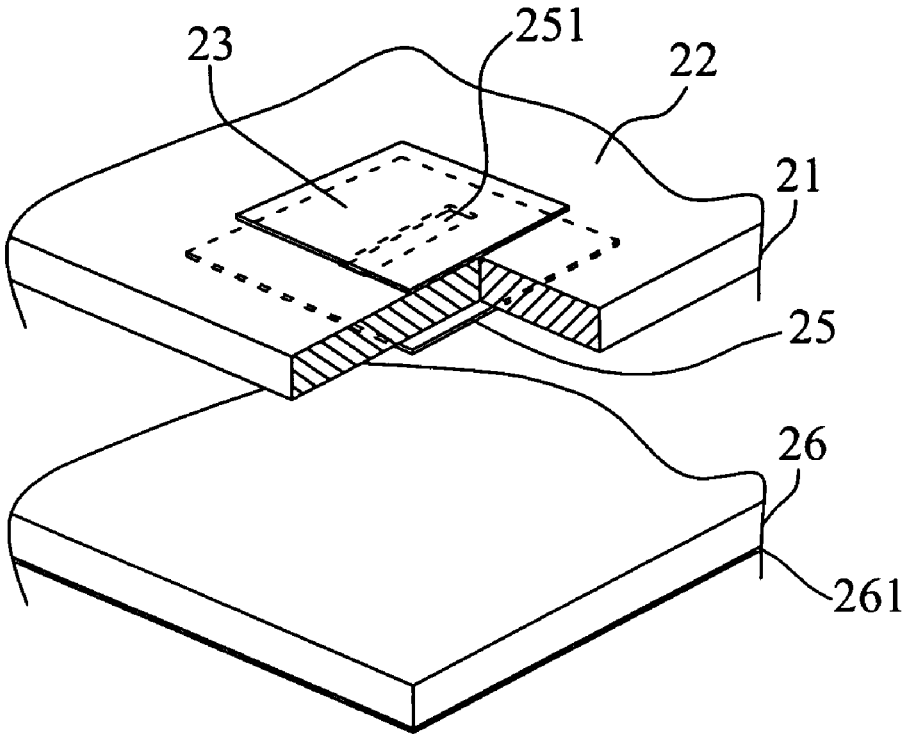
FIG. 3A is a schematic diagram showing part of the top substrate and the bottom substrate according to the first preferred embodiment of the present invention.

FIG. 3A is a three-dimensional schematic drawing of the antenna unit cell on the top substrate and the bottom substrate of the first preferred embodiment of the invention. As shown, the first microstrip antenna patch 23 of the antenna unit cell is disposed on the upper surface 22 of the top substrate 21, and the corresponding second microstrip antenna patch 25 with a slot is located on the lower surface of the top substrate 21. Besides, a grounding plate 261 is disposed on the bottom of the bottom substrate 26 for grounding. In this embodiment, the border-length (a2) of the first microstrip antenna patch 23 is 0.65 times of the border-length (a1) of the second microstrip antenna patch 25 (a2=0.65a1). However, the ratio of these two border-lengths is not fixed, and it changes according to the circumstances (e.g. the demand for the antenna's performance). Generally speaking, the ratio of these border-lengths is between 0.5 and 0.8. In addition, the length (L) and width (W) of the rectangular slot 251 is 0.6 and 0.2 times of the border-length (a1) of the second microstrip antenna patch 25, respectively (L=0.6a1, W=0.2a1).

Figure 3B:
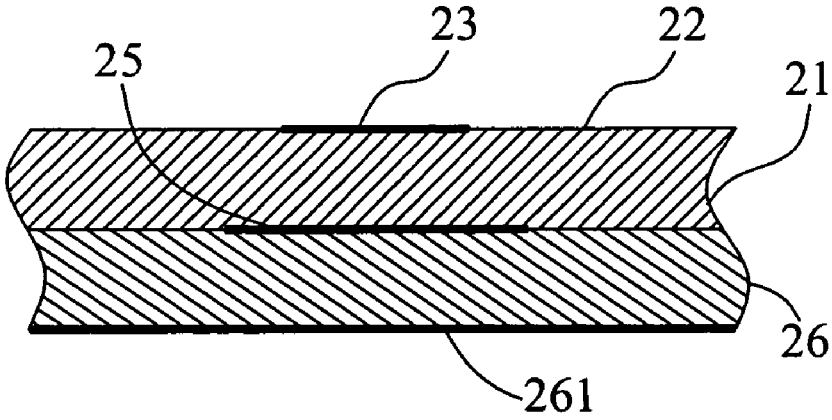
FIG. 3B is a cross-section view of FIG. 3A.

FIG. 3B shows a cross-section view of an antenna unit cell of the reflecting board, which is consisted of the aforesaid top substrate 21 and the aforesaid bottom substrate 26 according the first preferred embodiment. The top substrate 21 and the bottom substrate 26 are FR-4 microwave substrate with a dielectric constant (ϵ) of 4.4, and both of their thicknesses are 1.6 mm. Therefore, the thickness of the reflecting board of the first preferred embodiment is 3.2 mm, which is obviously smaller than the thickness (6 mm) of the conventional one.

Figure 4:
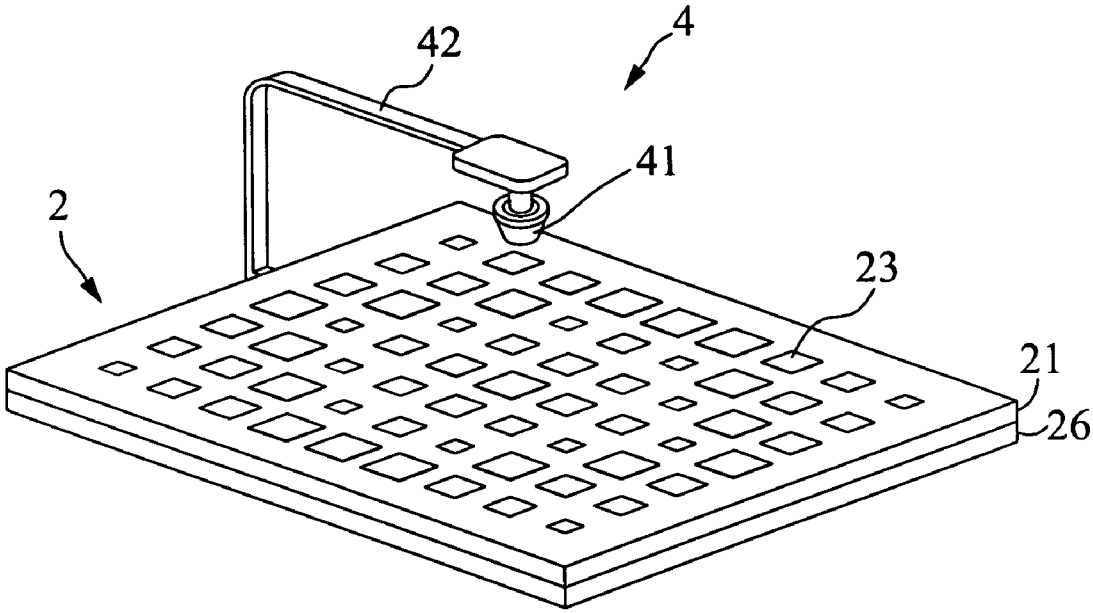
FIG. 4 is a schematic diagram of a microstrip reflectarray antenna according to the first preferred embodiment of the present invention.

FIG. 4 shows a schematic drawing of a microstrip reflectarray antenna of the first preferred embodiment. The length (L) and width (W) of the reflecting board 2, which comprises a top substrate 21 and a bottom substrate 26, are 25 mm and 19.5 mm, respectively. A horn 41 is coupled with the reflecting board 2 through a support 42 at a distance of 20 cm above the reflecting board 2. The horn 41 is used to transmit and receive a high-frequency signal between 10.4 to 12.4 GHz. From a performance test, the reflectarray antenna 4 shows 1.5 dB gain bandwidth of 19.3% with an aperture efficiency of 31.48%, and the cross-polarization level is below 25 dB. Besides, the reflectarray antenna 4 shows a maximum gain of 24.5 dB at 11.4 GHz.

The microstrip reflectarray antenna reflects the transmitted or received high-frequency signal to a transceiving element or a distant terminal receiving device by antenna unit cells disposed on the reflecting board. Therefore, phase difference is obtained while the high-frequency signal is reflected by the reflecting board, and this phenomenon is similar to that the high-frequency signal is reflected by a conventional parabolic reflecting board. In general, a whole period of phase change (the whole phase difference is 360°) is needed for the high-frequency signal reflected by the reflecting board at the antenna's working frequency and within the reflecting board's area restriction. Thus, to adapt to the standard design-demands of the reflecting board of the microstrip reflectarray antenna, such as gain, patch size ratios, bandwidth, or efficiency, several factors are considered in practical design. These factors comprise:

1. material of the reflecting board;
2. dimension of the antenna unit cell; and
3. configuration of the antenna unit cell.

Figure 5:
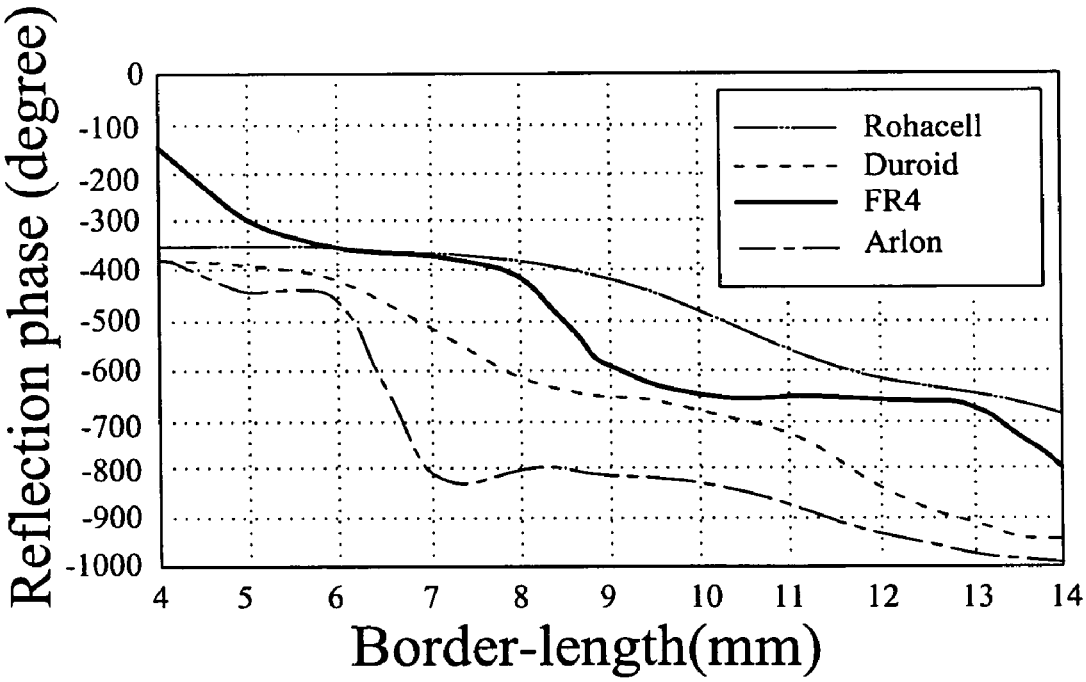
FIG. 5 shows a schematic diagram of reflection phase at 11 GHz versus border-length of the antenna patch in different materials according to a prior art microstrip reflectarray antenna.

FIG. 5 shows the relationship between the border-length of the antenna unit cell and the reflection phase of the high-frequency signal at 11 GHz with different materials of the reflecting board. Among them, the dielectric constant (ϵ) of Rohacell™ is 1.05, the dielectric constant (ϵ) of Duroid™ is 2.2, the dielectric constant (ϵ) of FR-4 is 4.4, and the dielectric constant (ϵ) of Arlon™ is 6.

From FIG. 5, the curves of Rohacell™ and Duroid™, the dielectric constants of which are lower than FR-4 and Arlon™, are smoother, and the stable-slope regions of them are greater than that of FR-4 and Arlon™. Moreover, the phase difference of Rohacell™ achieves 360°, and that of Duroid™ does as well. Therefore, the reflection phase distribution of the high-frequency signal reflected by the reflecting board can be regulated precisely by tuning the border-length or the location of antenna unit cell of the reflecting board to control the high-frequency signal's waveform and major reflecting direction. However, the area of the reflecting board is increased as each antenna element takes more space in a low dielectric constant environment than in a high dielectric constant environment.

On the other hand, the curves of FR-4 and Arlon™, the dielectric constants of which are higher than Rohacell™ and Duroid™, are steeper, and the stable-slope regions of them are smaller than that of Rohacell™ and Duroid™. Besides, the phase difference of FR-4 achieves 360°, and that of Arlon™ does as well. Therefore, the reflection phase changes obviously while the border-length of the antenna unit cell changes only slightly. The manufacturing tolerance should be strictly controlled.

As the reflecting board with high dielectric constant is not formed precisely, it cannot accurately reflect the high-frequency signal to the transceiving element or the distant terminal receiving device, and the performance of the microstrip reflectarray antenna, such as gain, patch size ratios, bandwidth, or efficiency, is impaired. In other words, the performance of the reflecting board with high dielectric constant is very sensitive to manufacturing error of the antenna unit cell's border-length. Thus, it is difficult to design a reflecting board with high dielectric constant for the microstrip reflectarray antenna, and the good yield of the reflecting board is reduced. However, from a viewpoint of cost, the material of the reflecting board with high dielectric constant, such as FR-4, is much cheaper than that with low dielectric constant. If the aforesaid questions can be overcome, the reflecting board with high dielectric constant can be mass-produced, and the cost of the whole microstrip reflectarray antenna can be reduced.

Figure 6A:
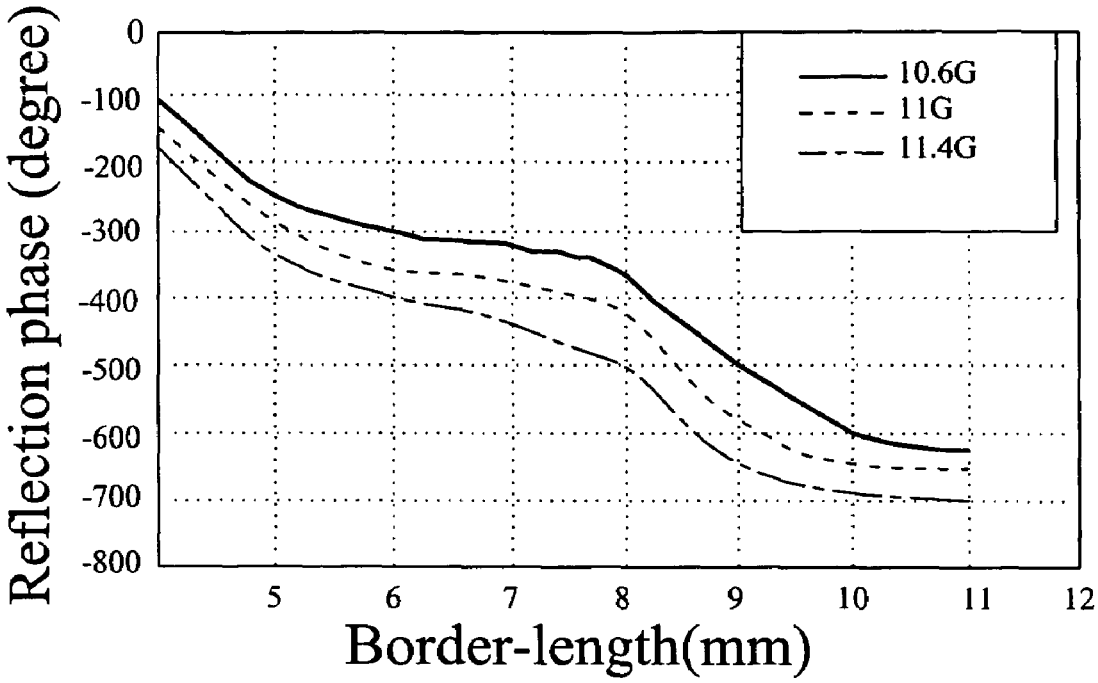
FIG. 6A shows a schematic diagram of reflection phase versus border-length of the second microstrip antenna patch on an FR-4 reflecting board ($\epsilon$=4.4) at different working frequency according to the first preferred embodiment of the present invention.
Figure 6B:
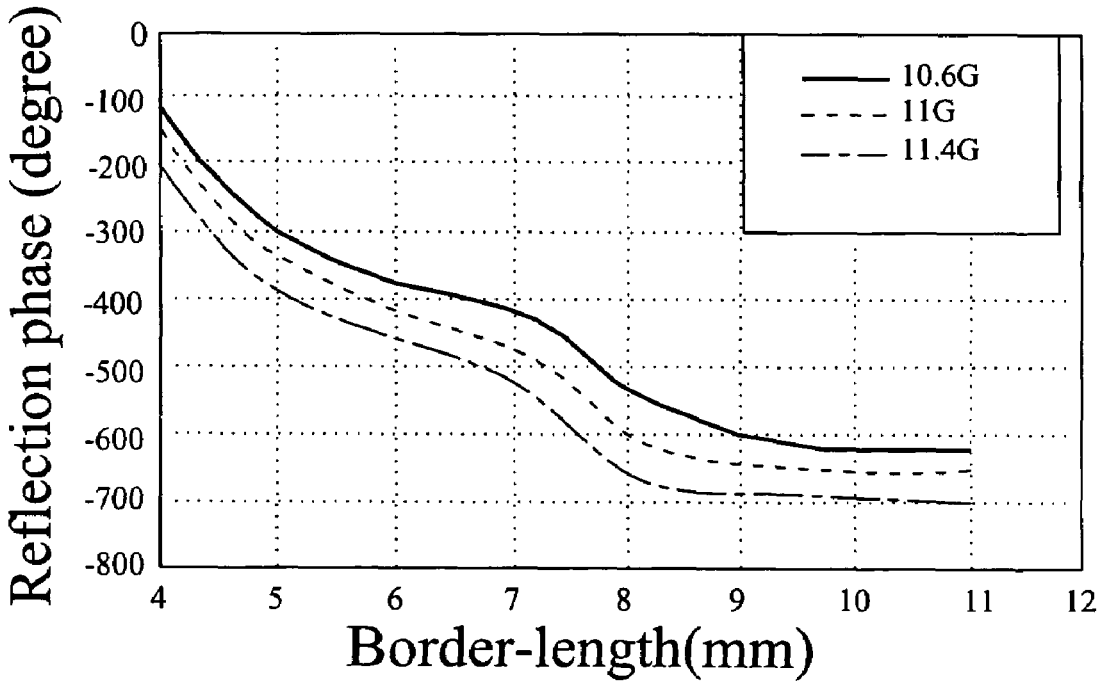
FIG. 6B shows a schematic diagram of reflection phase versus border-length of the second microstrip antenna patch on an FR-4 reflecting board ($\epsilon$=4.4) at different working frequency according to the first preferred embodiment of the present invention.

The FR-4 microwave substrate is not only cheap but also widely used in all kinds of microstrip antenna. Therefore, the material of the reflecting board for the microstrip reflectarray antenna of the first preferred embodiment is FR-4, the dielectric constant of which is 4.4. FIG. 6A shows the relationship between the border-length of the second microstrip antenna patches without a rectangular slot and the reflection phase of the high-frequency signal reflected by the antenna unit cell at different working frequencies (10.6 GHz, 11 GHz, and 11.4 GHz). On the other hand, FIG. 6B shows the relationship between the border-length of the second microstrip antenna patches having a rectangular slot and the reflection phase of the high-frequency signal reflected by the antenna unit cell at different working frequencies (10.6 GHz, 11 GHz, and 11.4 GHz). Besides, the length (L) and the width (W) of the rectangular slot are 0.6 times and 0.2 times of the border-length (a1) of the second microstrip antenna patch (L=0.6a1, W=0.2a1).

As shown in FIG. 6A, the curves have a stable slope and achieve a reflection phase of 360 degrees while the border-length of the second microstrip antenna patch is in the range of 7 to 9 mm, However, the reflection phase in this region still changes 166.1 degrees as the border-length of the second microstrip antenna patch changes 1 mm. Besides, the border-length of the second microstrip antenna patch has to be longer than 7 mm. Therefore, each antenna unit cell occupies an area of 49 $mm^2$ at least, and the area of the reflecting board therefore cannot be reduced.

Compared with the layout curves of FIG. 6A, the stable-slope region (i.e. the region ranges from 4.5 to 7.5 mm) of the layout curves as shown in FIG. 6B is increased, and the slopes of curves in this range are decreased. Thus the area of the reflecting board can be reduced and the manufacturing tolerance can be easily controlled. Besides, the performance of the reflecting board remains good even though the border-length of the second microstrip antenna patch changes slightly. Therefore, through forming a slot on the second microstrip antenna patch, the difficulties in design of the reflecting board are diminished, and the yield of the reflecting board is increased. In this embodiment, the slot can be formed by etching.

Figure 7:
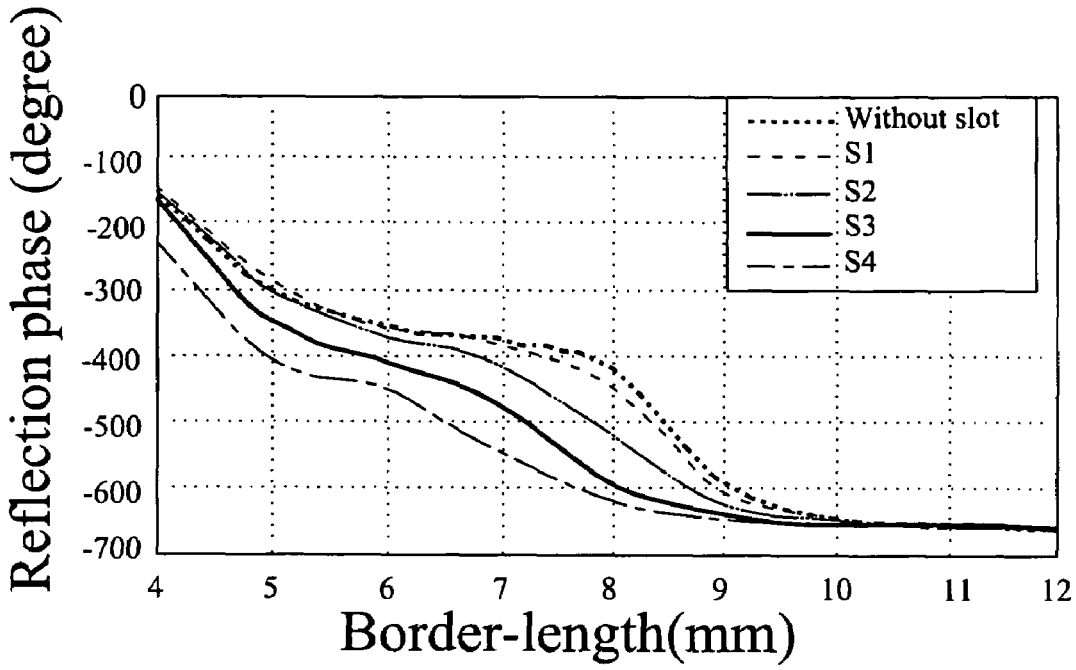
FIG. 7 shows a schematic diagram of reflection phase versus border-length of the second microstrip antenna patch on an FR-4 reflecting board ($\epsilon$=4.4) at 11 GHz according to the first preferred embodiment of the present invention.

FIG. 7 shows the relationship between the border-length of the second microstrip antenna patch and the reflection phase of the high-frequency signal reflected by the reflecting board. In FIG. 7, the ratio of the maximum border-length (L) of the rectangular slot to the maximum border-length (a1) of the corresponding second microstrip antenna patch is different for each curve. Actually, the ratio of curve S1 is 0.2 (L=0.2a1), the ratio of curve S2 is 0.4 (L=0.4a1), the ratio of curve S3 is 0.6 (L=0.6a1), the ratio of curve S4 is 0.8 (L=0.8a1), and the ratio of curve labeled as "without slot" is zero.

Among the curves in FIG. 7, the curve S3 is shown to have a larger stable-slope region and a smoother slope than any other curve in FIG. 7. Therefore, in the first preferred embodiment of the present invention, the border-length (a1) and location of the second microstrip antenna patch is designed according to the conditions of curve S3. As soon as the border-length (a1) and location of the second microstrip antenna patch are decided, the length (L=0.6a1) and width (W=0.2a1) of the rectangular slot, and the border-length (a2=0.65a1) of the corresponding first microstrip antenna patch are also decided. Moreover, FR-4 microwave substrate, which is cheap, may be used as the material of the reflecting board.

In other words, a microwave substrate with high dielectric constant but low price can be used as the material of the reflecting board of the first preferred embodiment. Compared with the conventional reflecting board, the cost for the reflecting board of this embodiment is lessened, the difficulties in design are reduced, and the yield of the reflecting board is increased.

Figure 8:
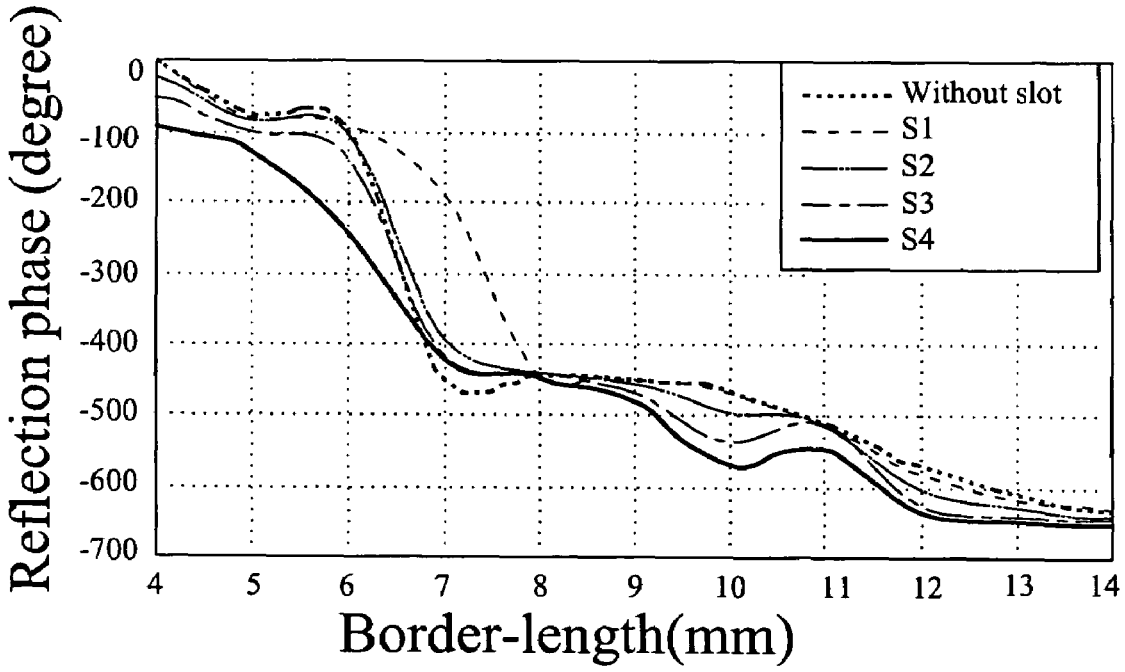
FIG. 8 shows a schematic diagram of reflection phase versus border-length of the second microstrip antenna patch on an Arlon™ reflecting board ($\epsilon$=6) at 11 GHz according to the second preferred embodiment of the present invention.

FIG. 8 shows the relationship between the relationship between the border-length of the second microstrip antenna patch and the reflection phase of the high-frequency signal reflected by the reflecting board at 11 GHz. In this embodiment, the reflecting board is an Arlon™ microwave substrate with high dielectric constant. In FIG. 8, the ratio of the maximum border-length (L) of the rectangular slot to the maximum border-length (a1) of the corresponding second microstrip antenna patch is different for each curve. Actually, the ratio of curve S1 is 0.2 (L=0.2a1), the ratio of curve S2 is 0.4 (L=0.4a1), the ratio of curve S3 is 0.6 (L=0.6a1), the ratio of curve S4 is 0.8 (L=0.8a1), and the ratio of curve labeled as "without slot" is zero.

Among the curves in FIG. 8, the curve S4 is shown to have a larger stable-slope region and smoother slope than any other curve in FIG. 8. Therefore, in the second preferred embodiment of the present invention, the border-length (a1) and location of the second microstrip antenna patch are designed according to the conditions of curve S4. As soon as the border-length (a1) and location of the second microstrip antenna patch are decided, the length (L=0.8a1) and width (W=0.2a1) of the rectangular slot, and the border-length (a2=0.65a1) of the corresponding first microstrip antenna patch are also decided. As a result, the microstrip reflectarray antenna of this embodiment can tolerate manufacturing error even though an Arlon™ microwave substrate with high dielectric constant is used as the material of the reflecting board.

Compared with the conventional reflecting board, the dielectric constant of the material of the reflecting board of this embodiment is enhanced, the area of the reflecting board is reduced, and the design flexibility is increased.

In other words, through forming a rectangular slot in the second microstrip antenna patch, the design flexibility of the reflecting board can be enhanced, the area of the reflecting board can be reduced, and the sensitivity of the performance of the microstrip reflectarray antenna to the manufacturing precision is lowered. Furthermore, the microstrip reflectarray antenna can tolerate the same range of manufacturing error whether the dielectric constant of the reflecting board is high or not. Consequently, the cost for the reflecting board and the microstrip reflectarray antenna of the present invention is diminished, the area of the reflecting board and the microstrip reflectarray antenna of the present invention is reduced, and the yield of the reflecting board is improved.

Although the present invention has been explained in relation to its preferred embodiment, it is to be understood that many other possible modifications and variations can be made without departing from the scope of the invention as hereinafter claimed.

What is claimed is:

1. A reflecting board for a microstrip reflectarray antenna, comprising:

a bottom substrate having a first lower surface, wherein a grounding plate is disposed on the first lower surface to ground the bottom substrate; and a top substrate having an upper surface, a second lower surface, plural first microstrip antenna patches, and plural second microstrip antenna patches, wherein the first microstrip antenna patches are disposed on the upper surface and the second microstrip antenna patches with rectangular slots are disposed on the second lower surface;

wherein each second microstrip antenna patch on the second lower surface is located opposite to the corresponding first microstrip antenna patch on the upper surface of the top substrate, the ratio of the area of the first microstrip antenna patch to the area of the corresponding second microstrip antenna patch is identical for each first microstrip antenna patch on the upper surface of the top substrate, and the ratio of the maximum border-length of the rectangular slot to the maximum border-length of the corresponding second microstrip antenna patch is identical for each second microstrip antenna on the second lower surface of the top substrate.

2. The reflecting board as claimed in claim 1, wherein the reflecting board is co-operated with a transceiving element locating above the top substrate to receive and transmit a high-frequency signal.

3. The reflecting board as claimed in claim 2, wherein the transceiving element is a horn.

4. The reflecting board as claimed in claim 2, wherein the frequency of the high-frequency signal ranges from 10.4 to 12.4 GHz.

5. The reflecting board as claimed in claim 2, wherein the transceiving element is coupled with the reflecting board through a support.

6. The reflecting board as claimed in claim 1, wherein the bottom substrate is an FR-4 microwave substrate.

7. The reflecting board as claimed in claim 1, wherein the top substrate is an FR-4 microwave substrate.

8. The reflecting board as claimed in claim 1, wherein the dielectric constant of the bottom substrate ranges from 2 to 12.

9. The reflecting board as claimed in claim 1, wherein the dielectric constant of the top substrate ranges from 2 to 12.

10. The reflecting board as claimed in claim 1, wherein the shape of the reflecting board is a square.

11. The reflecting board as claimed in claim 1, wherein the material of the grounding plate is metal.

12. The reflecting board as claimed in claim 1, wherein the material of the first microstrip antenna patch is metal.

13. The reflecting board as claimed in claim 1, wherein the material of the second microstrip antenna is metal.

14. The reflecting board as claimed in claim 1, wherein the shape of the first microstrip antenna is a square.

15. The reflecting board as claimed in claim 1, wherein the shape of the second microstrip antenna is a square.

16. The reflecting board as claimed in claim 1, wherein the shape of the first microstrip antenna patch is identical to that of the second microstrip antenna patch.

17. The reflecting board as claimed in claim 16, wherein the border-length of the first microstrip antenna patch is 0.6 to 0.7 times of the corresponding border-length of the corresponding second microstrip antenna patch.

18. The reflecting board as claimed in claim 1, wherein the maximum border-length of the rectangular slot is 0.5 to 0.7 times of the corresponding border-length of the corresponding second microstrip antenna patch.

* * * * *